United States Patent [19]

Yatabe et al.

[11] Patent Number: 4,510,901

[45] Date of Patent: Apr. 16, 1985

[54] THROTTLE VALVE CONTROL APPARATUS

[75] Inventors: Fumio Yatabe, Kawagoe; Syunzaburo Ozaki, Sakado, both of Japan

[73] Assignee: Honda Giken Kogyo Kabushiki Kaisha, Tokyo, Japan

[21] Appl. No.: 475,605

[22] Filed: Mar. 15, 1983

[30] Foreign Application Priority Data

Mar. 17, 1982 [JP] Japan ..... 57-41898

[51] Int. Cl.[3] ..... F02M 3/00

[52] U.S. Cl. ..... 123/325; 123/340

[58] Field of Search ..... 123/339, 340, 320, 325, 123/399, 401, 403, DIG. 11; 261/DIG. 19

[56] References Cited

U.S. PATENT DOCUMENTS 3,682,148 8/1972 Harrison et al. ..... 123/198 DB 4,144,852 3/1979 Kawai et al. ..... 123/320

4,192,279 3/1980 Maisch et al. ..... 123/333

4,391,246 7/1983 Kawabata et al. ..... 123/340

*Primary Examiner*—William A. Cuchlinski, Jr.

*Attorney, Agent, or Firm*—Armstrong, Nikaido, Marmelstein & Kubovcik

[57] ABSTRACT

Apparatus to control throttle valve position during deceleration of an engine which includes a first stopper for stopping closing movement of the throttle valve at the idling position, a mechanism for removing the first stopper from operation at the time of deceleration, and a second stopper for stopping movement of the throttle valve at a closed-valve position which is beyond the idling position in the closing direction. The mechanism for removing includes a delay mechanism for delaying the foregoing removal of the first stopper at the time of deceleration.

4 Claims, 1 Drawing Figure

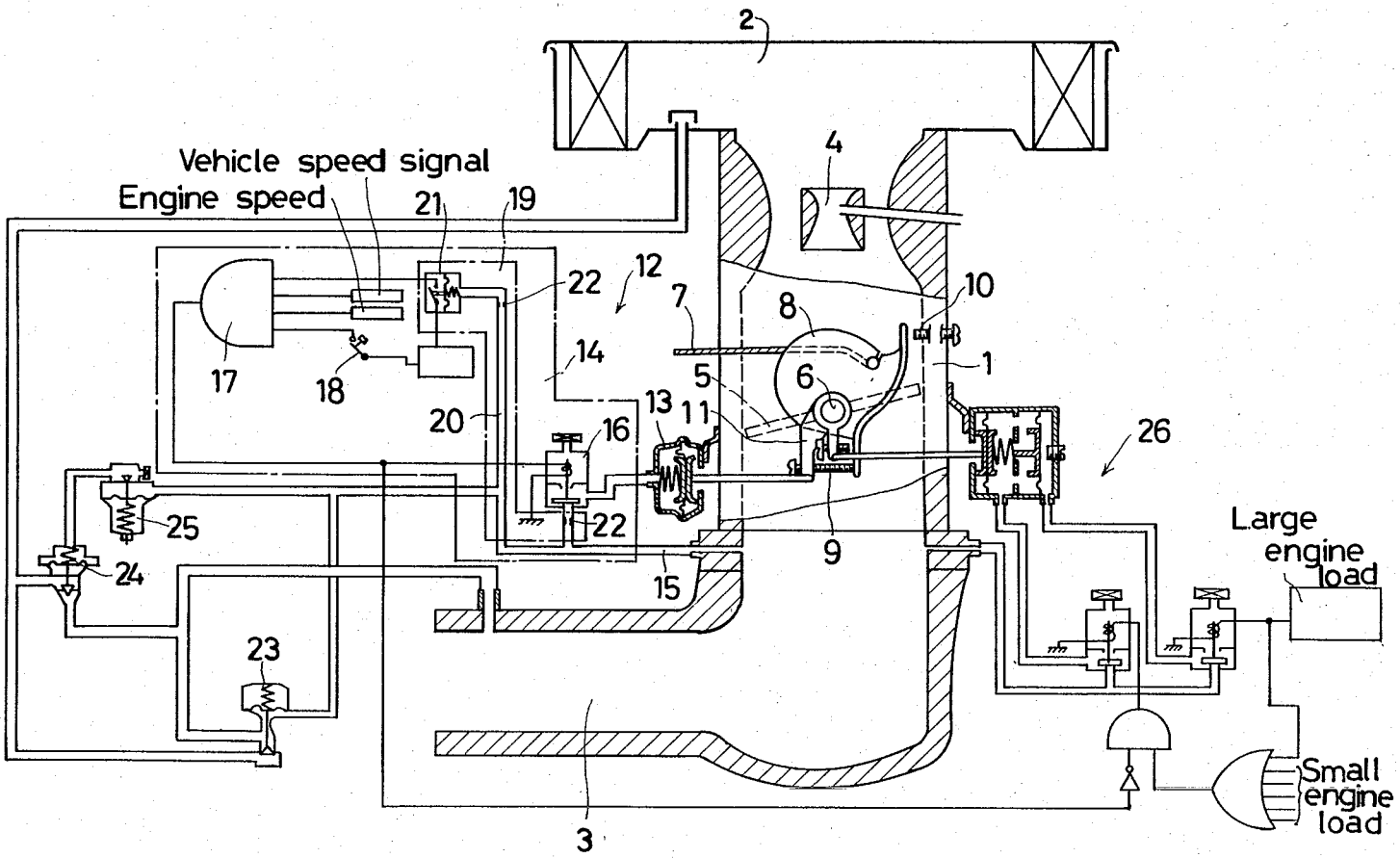
Large engine load
Small engine load
Vehicle speed signal
Engine speed
1
2
3
4
5
6
7
8
9
10
11
12
13
14
15
16
17
18
19
20
21
22
23
24
25
26

THROTTLE VALVE CONTROL APPARATUS

BACKGROUND OF THE INVENTION

This invention relates to an apparatus for control of a throttle valve of an internal combustion engine mounted in a motorcar or the like.

There has been hitherto known an apparatus for controlling a throttle valve which includes a first stopper means for stopping a closing movement of a throttle valve at an idling position thereof. The throttle valve is provided in the intake passage of the engine. The known apparatus also includes means for removing the first stopper means from operation at the time of deceleration. At operation of the means for removing, the throttle valve is allowed to move further in its closing direction beyond the idling position to a closed-valve position. At the closed-valve position, the throttle valve is stopped by a second stopper means. In this manner, the amount of fuel consumption decreases at the time of deceleration to effect an improved fuel economy. This type of apparatus, however, has a problem in that at the time of deceleration from a high load operation with the throttle valve being widely open, the return of the throttle valve from its wide open position directly to a closed-valve position thereof produces a large shock on the second stopper means. This increases wear of the same and the durability thereof is lowered.

OBJECT AND SUMMARY OF THE INVENTION

This invention has for its object to provide an apparatus which reduces wear and increases durability of the second stopper means.

Such an apparatus comprises a first stopper means for stopping at an idling position a closing movement of a throttle valve which is provided in an intake passage of an engine, means for removing the first stopper means from operation at the time of deceleration thereby allowing the throttle valve to move further in its closing direction beyond the idling position to a closed-valve position, and second stopper means for stopping closing movement of the throttle valve at the closed-valve position; said means for removing including delay means for delaying the foregoing removal of the first stopper means from operation at the time of deceleration.

BRIEF DESCRIPTION OF THE DRAWING

The drawing is a system diagram showing one example of this invention apparatus.

DETAILED DESCRIPTION OF A PREFERRED EMBODIMENT

One embodying example of this invention will be explained with reference to the accompanying drawing:

Referring to the drawing, the intake passage 1 of an internal combustion engine has therein a carburetor 4 and a throttle valve 5 on the downstream side thereof. An air cleaner 2 is provided on the upstream end of the intake passage 1 and an intake manifold 3 is provided on the downstream side thereof.

The throttle valve 5 is turnably provided in the intake passage 1. A lever member 8 having a throttle wire 7 attached thereto and connected to an acceleration pedal (not shown) is fixed to a rotary shaft 6 of the throttle valve 5 so that the throttle valve 5 may be turned in an opening direction counterclockwise in the drawing by pulling of the wire 7 and be turned in a closing direction clockwise by the action of a return spring (not shown) by releasing the wire 7 from being pulled. In addition, there is provided a first stopper means 9 for stopping the turning of the throttle valve 5 in its closing direction at its idling position. Additionally, at the time of deceleration, the first stopper means 9 is removed from operation by a means 11, 12 for removing and thereby the valve 5 is allowed to turn further in its closing direction beyond the idling position to a closed-valve position thereof at which the throttle valve is stopped by a second stopper means 10.

These stopper means 9, 10 are composed of respective stopper screws arranged to be brought into abutment with the foregoing lever member 8. In this case, the screw for the first stopper means 9 is attached to a swing arm 11 swingably supported on the foregoing rotary shaft 6 so that the first stopper means 9 may be removed from operation by the arm 11 being swung to move clockwise by means 12 and accordingly the screw is retreated from the illustrated stopping position to its removal position, that is, to the left in the drawing at the time of deceleration. The second stopper means 10 may be constructed by a body itself of the intake passage 1.

The means 12 for removing comprises a negative pressure actuator 13 connected to the arm 11 and a negative pressure control system 14 serving to apply a negative pressure from the intake passage 1 to the negative pressure actuator 13. The control system 14 comprises a negative pressure passage 15, a control valve 16 interposed therein, and a control circuit 17 for the control valve. The control circuit 17 is composed of an AND circuit arranged to be inputted with a vehicle speed signal, an engine speed signal and an ON-OFF signal of a clutch switch 18 arranged to be moved with a clutch pedal (not shown). The AND circuit is so arranged that a high level output is generated from the control circuit 17 only under such a predetermined driving condition that the vehicle speed and the engine speed are respectively above set values and the clutch switch 18 is in its ON condition (an inoperative condition of the clutch pedal), and by generation of the same, the control valve 16 is opened. Accordingly, the negative pressure in the intake passage 1 is applied through the control valve 16 to the negative pressure actuator 13, and thereby the actuator 13 is operated to cause the foregoing removal of the first stopper means 9 from the stopping operation.

The above construction is not especially different from that in a conventional apparatus. According to this invention, the means 12 for removing the first stopper means 9 is provided with a delay means 19 so that the foregoing removal of the first stopper means 9 at the time of deceleration may be delayed.

This will be explained more in detail with reference to the illustrated example. Namely, the delay means 19 includes means provided in the foregoing negative pressure control system 14 for delaying the application of the negative pressure to the negative pressure actuator 13. The foregoing arrangement is composed of a negative pressure switch 21 provided on the input side of the foregoing control circuit 17 and arranged to be applied with the negative pressure from the intake passage 1 through a diverged passage 20 diverged from the foregoing negative pressure passage 15, and throttle jets 22 interposed respectively in the negative pressure passage 15 and the diverged passage 20, respectively.

The negative pressure switch 21 is an ordinarily open type one, and is so arranged that the foregoing high level output is not generated from the control circuit 17 even under the foregoing predetermined driving condition, but when the negative pressure in the intake passage 1 becomes large by turning in the closing direction of the throttle valve 5 at the time of deceleration, the negative pressure switch 21 becomes ON and by the ON signal thereof, the high level output is generated from the control circuit 17.

Next, the operation of the apparatus will be explained as follows:

At the time of a high load operation of the engine, the throttle valve 5 is at its widely open position, and the negative pressure in the intake passage 1 is comparatively small and the negative pressure switch 21 is kept in its OFF condition. Thus, the control valve 16 is kept in its closed condition and the first stopper means 9 is kept in its predetermined stopping position. If, under this condition, a deceleration operation is carried out, the turning of the throttle valve 5 in its closing direction by the action of the return spring is once stopped at the idling position by the first stopper means 9 located at its stopping position, that is, its operation position, and after the lapse of a predetermined delay time until the negative pressure in the intake passage 1 becomes large and the negative pressure switch 21 becomes ON. Then, there is generated the high level output from the control circuit 17, whereby the control valve 16 is opened and the negative pressure from the intake passage 1 is applied to the negative pressure actuator 13. When the first stopper means 9 is retreated, that is, removed from its operation by the operation of the actuator 13, the throttle valve 5 is turned to the closed-valve position, and is stopped at that position by the second stopper means 10. In this case, the foregoing respective jets 22 serve to delay the application of the negative pressure to the negative pressure switch 21 and the negative pressure actuator 13, respectively, whereby the removal of the first stopper means 9 is further delayed.

As described above, at the time of deceleration under the high load operation condition, the removal of the first stopper means 9 from operation is delayed, and the throttle valve 5 is turned to the closed-valve position after once being received by the first stopper means 9, and consequently, a shock against the second stopper means 10 becomes small. Wear of the second stopper means is minimized.

At the time of a low load operation of the engine, the throttle valve 5 is at a very small open position and the negative pressure in the intake passage 1 is large, so that the negative pressure switch 21 becomes ON before the deceleration operation and consequently the first stopper means 9 is removed previously to the deceleration. Thus, the throttle valve 5 is turned directly to the closed-valve position simultaneously with the deceleration operation. In this case, however, the turning of the throttle valve 5 is that from the low open position, so that a shock against the second stopper means 10 is small.

Referring to the drawing, an anti-after burning valve means 23 and a secondary air valve means 24 are provided in parallel with one another and serve to introduce a secondary air to the intake manifold 3. A control valve means 25 for the secondary air valve 24, and an idle-up means 26 for increasing an idling open degree of the throttle valve 5 according to load at the time of idling operation are also provided.

Thus, according to this invention, the removal of the first stopper means from operation at the time of deceleration is delayed by the delay means, so that a rapid or direct turning of the throttle valve to the closed-valve position, at the deceleration under a high load operation condition, can be prevented, and a shock against the second stopper means serving to receive the valve at the closed-valve position can be decreased, and the durability of the valve can be improved.

It is readily apparent that the above-described throttle control apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A throttle valve control apparatus in an internal combustion engine having an intake passage and a throttle valve therein, said apparatus comprising:

stopper means for stopping closing movement of the throttle valve at an idling position thereof, means for removing the first stopper means at the time of deceleration from operation, thereby allowing throttle valve to move further in its closing direction beyond the idling position to a closed-valve position thereof, and a second stopper means for stopping closing movement of the throttle valve at the closed-valve position;

said means for removing including delay means for delaying the foregoing removal of the first stopper means at the time of deceleration.

2. A throttle valve control apparatus of claim 1, wherein the means for removing further comprises a negative pressure actuator arranged to be operated by a negative pressure to remove the first stopper means from operation and a negative pressure control system arranged to apply a negative pressure from the intake passage to the actuator; and said delay means is provided in the negative pressure control system and includes means for delaying the application of the negative pressure to the actuator.

3. A throttle valve control apparatus of claim 2, wherein the negative pressure control system comprises a negative pressure passage, a control valve interposed therein and a control circuit for the control valve, the control circuit comprises an AND circuit arranged to be inputted with a vehicle speed signal, an engine speed signal and an ON-OFF signal of a clutch switch arranged to be moved with a clutch pedal so that a high level output is generated therefrom to open the control valve only under such a predetermined operation condition that the vehicle speed and the engine speed are respectively above set values and the clutch pedal is in its inoperative condition and accordingly the clutch switch is in its ON condition.

4. A throttle valve control apparatus of claim 3, wherein the means for delaying application of negative pressure comprises a negative pressure switch provided on the input side of the AND circuit and arranged to be applied with a negative pressure from the intake passage through a diverged passage diverged from the negative pressure passage, and respective throttle jets interposed respectively in the negative pressure passage and the diverged passage.

* * * * *